US008016104B2

(12) United States Patent
Hjalmarsson

(10) Patent No.: US 8,016,104 B2
(45) Date of Patent: Sep. 13, 2011

(54) TWO-COMPARTMENT CONTAINER HAVING DEPRESSIBLE FLEXIBLE DOME FOR RUPTURING LAYER BETWEEN COMPARTMENTS

(75) Inventor: Per Hjalmarsson, Malmo (SE)

(73) Assignee: Biogaia AB, Stockholm (SE)

( * ) Notice: Subject to any disclaimer, the term of this patent is extended or adjusted under 35 U.S.C. 154(b) by 460 days.

(21) Appl. No.: 11/257,516

(22) Filed: Oct. 25, 2005

(65) Prior Publication Data

US 2007/0090000 A1 Apr. 26, 2007

(51) Int. Cl.
*B65D 25/08* (2006.01)
*B65D 85/84* (2006.01)

(52) U.S. Cl. ..... 206/219; 206/524.3; 215/DIG. 8

(58) Field of Classification Search ..... 206/219–222, 206/524.3, 524.9; 215/DIG. 8
See application file for complete search history.

(56) References Cited

U.S. PATENT DOCUMENTS

| | | | | |
|---|---|---|---|---|
| 2,631,521 | A | 3/1953 | Atkins, Jr. | |
| 3,326,363 | A | 6/1967 | Bennett et al. | |
| 3,349,965 | A | 10/1967 | Krugger | |
| 3,406,872 | A | 10/1968 | Fiquet et al. | |
| 3,415,360 | A | 12/1968 | Baumann et al. | |
| 3,762,540 | A * | 10/1973 | Baumann et al. | 206/219 |
| 3,779,372 | A | 12/1973 | de Lloret | |
| 3,968,820 | A | 7/1976 | Kolb et al. | |
| 4,074,827 | A | 2/1978 | Labe, III | |
| 4,103,772 | A | 8/1978 | Wiegner | |
| 4,609,369 | A | 9/1986 | Ball | |
| 4,637,934 | A | 1/1987 | White | |
| 4,757,916 | A | 7/1988 | Goncalves | |
| 4,785,931 | A | 11/1988 | Weir et al. | |
| 4,786,279 | A | 11/1988 | Wilkinson et al. | |
| 4,874,618 | A | 10/1989 | Seaborne et al. | |
| 5,035,320 | A | 7/1991 | Plone | |
| 5,071,034 | A * | 12/1991 | Corbiere | 222/80 |
| 5,170,888 | A | 12/1992 | Goncalves | |
| 5,255,812 | A | 10/1993 | Hsu | |
| 5,290,574 | A | 3/1994 | Jamieson et al. | |
| 5,370,222 | A | 12/1994 | Steigerwald et al. | |
| 5,417,321 | A | 5/1995 | Halm | |
| 5,419,429 | A | 5/1995 | Zimmerman et al. | |
| 5,514,394 | A * | 5/1996 | Lenahan | 426/120 |
| 5,564,600 | A | 10/1996 | Renault | |
| 5,884,759 | A | 3/1999 | Gueret | |

(Continued)

FOREIGN PATENT DOCUMENTS

FR 2290366 4/1976

OTHER PUBLICATIONS

English Translation of FR 2290366 to Contrapac.*

*Primary Examiner* — Jila M Mohandesi
*Assistant Examiner* — Melissa L Lalli
(74) *Attorney, Agent, or Firm* — Lynn E. Barber

(57) ABSTRACT

A two-compartment container in which the first compartment has an upper layer and a lower layer and contains a first component that is to be added to the second compartment. Above the first compartment is a dome that is bowed upward and is flexible. Depressing the dome by pushing downward on it causes the lower layer of the first compartment to be ruptured without cutting or rupturing the upper layer, releasing the first component into the second compartment.

2 Claims, 1 Drawing Sheet

U.S. PATENT DOCUMENTS

| | | | | |
|---|---|---|---|---|
| 5,979,164 | A * | 11/1999 | Scudder et al. | 62/4 |
| 6,003,728 | A | 12/1999 | Elliott | |
| 6,098,795 | A | 8/2000 | Mollstam et al. | |
| 6,105,760 | A | 8/2000 | Mollstam et al. | |
| 6,155,423 | A * | 12/2000 | Katzner et al. | 206/531 |
| 6,209,718 | B1 | 4/2001 | Mollstam et al. | |
| 6,435,341 | B1 | 8/2002 | Nobbio | |
| 6,454,088 | B2 | 9/2002 | Mollstam et al. | |
| 6,513,650 | B2 | 2/2003 | Mollstam et al. | |
| 6,769,539 | B2 | 8/2004 | Stern et al. | |
| 6,786,330 | B2 | 9/2004 | Mollstam et al. | |
| 7,055,683 | B2 * | 6/2006 | Bourque et al. | 206/219 |
| 7,090,880 | B1 * | 8/2006 | Droste et al. | 426/124 |
| 2003/0223219 | A1 * | 12/2003 | Ladyjensky | 362/34 |
| 2004/0026270 | A1 * | 2/2004 | Liang | 206/219 |
| 2005/0263414 | A1 * | 12/2005 | Harilela et al. | 206/221 |
| 2007/0199838 | A1 * | 8/2007 | Oh et al. | 206/219 |

* cited by examiner

TWO-COMPARTMENT CONTAINER HAVING DEPRESSIBLE FLEXIBLE DOME FOR RUPTURING LAYER BETWEEN COMPARTMENTS

BACKGROUND OF THE INVENTION

1. Field of the Invention

This invention relates to packages and containers, and in particular, pertains to containers having two compartments and that may be used to keep two components separate until use.

2. Description of the Related Art

Many different types of packages have been designed to enable product components to be kept separate until use and, in some cases, to allow one component to remain sterile until use of the product. In one type of two-compartment package, a stopper or other means is placed in the hole between the two compartments. For example, the two-compartment container of Halm (U.S. Pat. No. 5,417,321) comprises a one-piece container having two compartments assembled one upon another interlinked by a stoppered opening. The disclosure of all patents referred to herein is incorporated herein by reference.

Other two-compartment packages utilize a perforating unit to allow the two previously separated components to mix. See, for example, the patents of Goncalves (U.S. Pat. No. 5,170,888 which has a glass defining a first compartment, which is provided with a neck upon which is mounted a bottle defining a second compartment, with a membrane between the two compartments that is perforated when a perforating unit is displaced relative to the glass, and U.S. Pat. No. 4,757,916 which has two units separated by a cover perforatable as a result of the manipulation of a mixing perforator). The two-part container of Wiegner (U.S. Pat. No. 4,103,772) has a frangible partition of coated aluminum foil dividing the compartments and a piercing member mounted on a resilient portion transversely directed toward the partition. In the patent of White (U.S. Pat. No. 4,637,934) rigid penetrating means are used to penetrate a compartment closing diaphragm to allow nursing liquid to flow from the compartment to a communicating, attached nipple.

Two compartment packages have also been previously developed which have an opening container attached to the top of the package and are provided with a screw cap and a cylinder jacket shaped supporting ring. The cylinder jacket shaped supporting ring is attached to the top of the package by means of a fixing flange externally surrounding the opening disc and is provided on its inner surface with a raised thread. The ring surrounds the external thread of the plastic screw cap. A cutter is integrally molded onto the free edge of the screw cap, and is provided with a front cutting edge which passes at an angle through the free edge.

For such products as two-part epoxy glues, two compartments are also needed to keep the products from reacting, as in the patent of Wilkinson et al. (U.S. Pat. No. 4,786,279).

The dispenser of Renault (U.S. Pat. No. 5,564,600) has two compartments separated by a sealing member sealed against a seat, so that movement of one of the containers relative to the other causes the sealing member to move away from the seat and form an annular passage between the sealing member and the seat.

U.S. Pat. Nos. 6,209,718, 6,105,760, 6,513,650 and 6,786,330 disclose a two-compartment package, which keeps a first component separate from a liquid component until use, so that the first component does not become wetted until just before use. The two-compartment package keeps at least one of the components sterile until just before use, at or before which time, the two components may be easily mixed. The prior invention can thus be used for containers for the separate packaging of dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption.

U.S. Pat. No. 6,098,795 discloses a container and means for adding a selected component to a main package, thus forming a two-compartment container that keeps a first component, which may, for example, be moisture sensitive, from a second component, preferably a liquid, until a selected time before use. The delivery package, preferably containing a second component in a compartment inside a cavity in the delivery package, may be mountable on the outside surface of a main package. A puncture means is provided for cutting through the compartment and the main package to gain access to the main package, for example, to release the first component from the compartment into the main package. Alternatively, the main package may be a bag, such as an enteral bag in the preferred use of the first embodiment. In the second embodiment of the invention, the main package preferably is for holding a liquid beverage, and the delivery package is attached to the main package during the manufacturing process.

In some cases, such as with aseptically-filled bottles or cartons, there is a need to provide a means for adding a selected separate first component to a package after manufacture of the package and/or at a location on the package, which component may vary in concentration and/or composition, depending, for example, on the patient's history and diagnosis. Providing a means of attaching a first compartment to a package after both the first compartment and package have been manufactured allows a user to select both a particular first component to add to a package and the time and place of addition of the first component to the package. There is also need to have the capability to add beverage additives, particularly degradable or moisture-sensitive or oxygen-sensitive components (for example, vitamins) to liquid beverage bottles at or just before the time the beverage is consumed.

The types of structures used for many prior two-compartment containers are complicated and often subject to leakage. Thus, there remains a need to have two-compartment packages which keep a first component separate from a liquid component until use, so that the first component does not become wetted until just before use, that keep at least one of the components sterile until just before use, and in which the two components may be easily mixed just before use, and which has minimal or no leakage prior to mixing of the components and once the components have been mixed. For example, there is a need for such containers for the separate packaging of dried microbial cultures which are to be added to a food, liquid nutrition, medicine, or beverage product just before consumption, for the separate packaging of carbonation tablets from a liquid until just before consumption, and for separate packaging of for example vitamins, flavoring or coloring agents or other unstable components before addition to a beverage, liquid nutrition, medicine or beverage before consumption.

It is therefore an object of the invention to provide a two-compartment container that keeps a first component, which may be moisture sensitive, from a second component, preferably a liquid, until a selected time before use, and that then the separation between the components may be removed without utilizing a puncturing structure.

It is a further object of the invention to provide a two-compartment container that has improved manufacturability and decreased leakage.

Other objects and advantages will be more fully apparent from the following disclosure and appended claims.

SUMMARY OF THE INVENTION

The invention herein is a two-compartment container. The first compartment has an upper layer and a lower layer and contains a first component that is to be added to the second compartment. Above the first compartment is a dome that is bowed upward and is flexible. Depressing the dome by pushing downward on it causes the dome to rupture the lower layer of the first compartment, without rupturing the upper layer, releasing the first component into the second compartment.

Other objects and features of the inventions will be more fully apparent from the following disclosure and appended claims.

DETAILED DESCRIPTION OF THE INVENTION AND PREFERRED EMBODIMENTS THEREOF

The present invention provides an improved two-compartment container having a depressible dome to release a sensitive component from a first compartment into a second compartment by rupturing a lower layer between the compartments, with minimal or no possibility of leakage.

As used herein, the relative directional terms "above", "below" and the like are used to specify the relative orientations of the parts of the invention when the container is a bottle, carton or the like oriented having the opening of the second compartment facing upward. In particular structures or usages of the container of the invention, the container may be oriented in other manners without departing from the invention herein, and it is understood that in such instances, the actual orientation of the parts of the invention are correspondingly changed.

Figure 1:
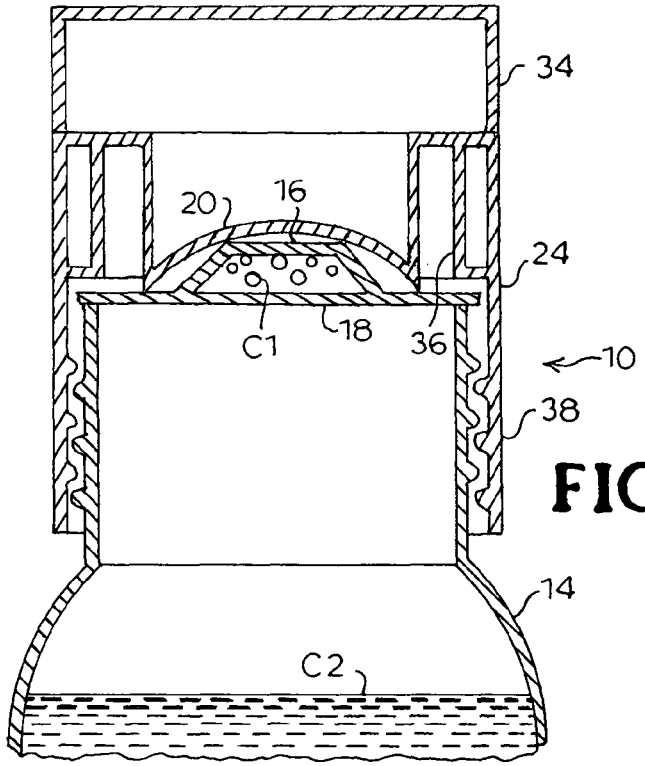
FIG. 1 is a cross-sectional view of the invention showing the dome when not depressed.
Figure 2:
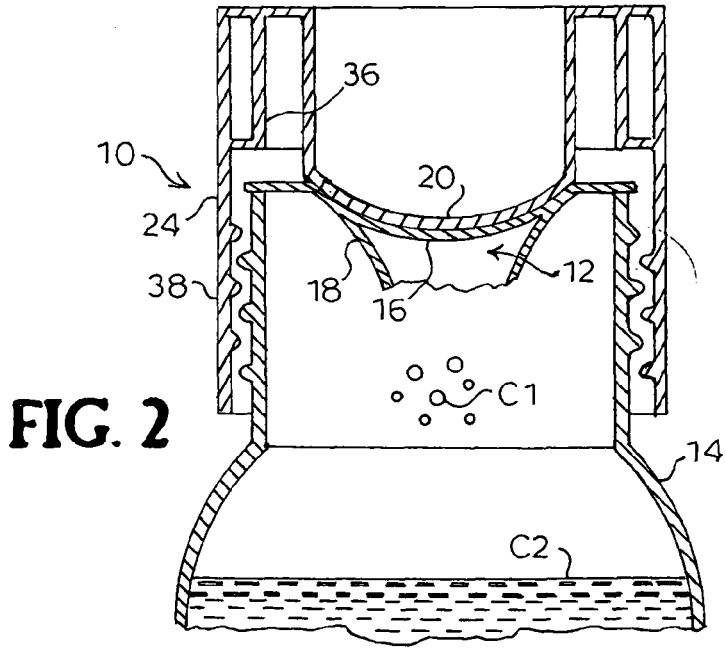
FIG. 2 is a cross-sectional view of the invention showing the dome when depressed.

In particular, the invention herein is container 10 comprising a first compartment 12 and a second compartment 14 (FIGS. 1-2). Although generally the second compartment 14 serves as the main compartment containing second component C2 that is normally a liquid, and the first compartment 12 serves as a delivery package for a first component C1 to be added to the second compartment 14, it is understood that by use of the terms "main" package and "delivery" package as used herein, no limitation is placed on the absolute or relative sizes of the packages. The terms are used merely to distinguish the two packages by difference in function and structural characteristics, with the main package including packages known in the prior art for holding substances and the delivery package preferably designed for holding a first component to be added to the main package. In the preferred embodiments herein, the second compartment 14 is a screw-capped bottle or a carton, such as a juice carton as is known in the art.

The first compartment 12 has an upper layer 16 and a lower layer 18 and contains a first component C1 that is to be added to the second compartment 14. The structure of the first compartment 12 is preferably similar to those disclosed in prior patents of the referred to above (see, for example, U.S. Pat. Nos. 6,098,795; 6,105,760; 6,209,718; and 6,786,330), the disclosure of which is incorporated herein by reference. Thus, a preferred first compartment 12 is preferably made of foil, and most preferably of foil having a plastic layer on one surface on the outside of the compartment, such as a polyvinyl laminated aluminum foil and with a lacquered surface on the inside such as OPA lacquer, for example, material nr 3131781 of ALCAN PACKAGING AG, (Kreuzlingen Switzerland). Above the first compartment 12 is a dome 20 that is part of the cap 24 covering the second compartment 14 and that is bowed upward and is flexible. Preferably, the dome 20 is formed of a thin flexible plastic material, as is known in the art.

In the invention herein, collar 36 extending above a threaded area 38 of the cap 24 holds the dome 20 suspended over the second compartment 14. Thus, in use of the invention, depressing the dome 20 by pushing downward on it lowers the dome 20 so that the lower layer 18 of the first compartment 12, but not upper layer 16, is ruptured by pressure of dome 20, releasing the first component C1 into the second compartment 14. Because upper layer 16 is not cut or ruptured, there is not leakage from the outer part due to the movement.

In the invention, the first compartment 12 is bowed upward, with the upper layer 16 preferably being quite thick, such as being made of a thick plastic and/or foil material. The flat lower layer 18 is a thin, easily rupturable foil. Thus, when dome 20 is depressed in this embodiment, it pushes upper layer 16 downward as shown in FIG. 2, so the intact but pushed downward upper layer 16 is pushed against and ultimately ruptures lower layer 18 as shown, without puncturing or rupturing upper layer 16.

In the invention, there is preferably an outer cap 34 over the cap 24, as shown in FIG. 1, which prevents accidental depression of the dome 20 prior to use, such as during shipping and storage. The form of this cap 34 may be any known in the art or as may be useful, and is not a specific part of the invention herein.

The invention is primarily designed for addition of a selected, sensitive first component C1, preferably located in first compartment 12, to a liquid located in the main package (second compartment 14). The term "selected" first component C1 as used herein includes first component(s) chosen for a particular use, e.g., addition to a bottle or carton to be used by a person requiring additional vitamins or antibiotics, or having a particular volume or concentration, and the like. The first component may be a single compound, mixture, solution, capsule, tablet, powder, or any other containable component(s) to be added to a main package that preferably contains a second component (which may in turn be any containable compound(s) to which the first component may be added to result in a useful product. The ability to select from an assortment of pre-packaged first components in the first embodiment herein allows the purchaser to purchase and store first and second components separately, for example, to keep non-perishable second components at room-temperature, and to keep first compartments, each of which has one of any number of assorted first components under appropriate, possibly separate, storage, for later addition to the second component. When the first component C1 comprises micro-organism cells, the first component is preferably in a powdered formulation as described in the parent applications hereto.

The term "sensitive" includes first components which are moisture-sensitive, or which interact with the second component, for example, by forming by-products that change the usefulness of the combined components, for example, from initially useful to too weak, due, for example, to loss or change of strength or value with time after the combination of components. "Sensitive" first components also include those components that may require special storage and/or handling until just before addition to a second component, for example, refrigeration, desiccation, or heating; as well as first components that for any other reason(s) are desired to be kept separate from a second component between the time of manufacture and until a later time, such as the time of addition to a second component.

It is preferred that the first component be in the form of a powder that is stable when dry and that is easily dissolved or suspended in the liquid in the main package as disclosed in the parent applications hereto. The invention is particularly useful for adding unstable and/or sterile components to a beverage, liquid enteral nutrition or medicine, for example, adding vitamins or beneficial gastrointestinal microorganisms, such as *Lactobacillus reuteri*, to fruit juice, milk, water, and medicine.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A two-compartment container, for addition of a first component to a second component, comprising:

(a) a first compartment having an intact upper layer and a lower layer, the upper layer comprising a plastic laminated aluminum foil and the lower layer comprising aluminum foil with a lacquered surface on the inside of the first compartment, said first compartment containing a first desiccated powdered component that is sensitive to moisture, said upper layer of the first compartment being upwardly bowed, and said lower layer of the first compartment being flat and thinner than the upper layer and easily rupturable without using a puncturing structure; and (b) a second compartment containing a second liquid component, said second compartment comprising a bottle having a cap containing a flexible dome;

wherein the first compartment is located inside the cap and beneath the flexible dome, and wherein depression of said flexible dome of the cap causes the intact upper layer of the first compartment to be pushed against the lower layer of the first compartment and the lower layer to be ruptured without using a puncturing structure and without rupturing the upper layer, releasing the first desiccated powdered component into the second compartment without opening either compartment outside the container.

2. A method of adding a first component to a second component, comprising:

(a) providing a first compartment having an intact upper layer and a lower layer, the upper layer comprising a plastic laminated aluminum foil and the lower layer comprising aluminum foil with a lacquered surface on the inside of the first compartment, said first compartment containing a first desiccated powdered component that is sensitive to moisture, said upper layer being upwardly bowed, the lower layer of said first compartment being flat and thinner than the upper layer and easily rupturable without using a puncturing structure;

(b) providing a second compartment containing a second liquid component, said second compartment comprising a bottle having a cap containing a flexible dome, wherein the first compartment is located inside the cap and beneath the flexible dome; and (c) depressing said flexible dome of the cap and causing the intact upper layer of the first compartment to be pushed against the lower layer of the first compartment to cause the lower layer to be ruptured without using a puncturing structure and without rupturing the upper layer, releasing the first desiccated powdered component into the second compartment without opening either compartment outside the container.

* * * * *